US005606955A

United States Patent [19]

Yuda

[11] Patent Number: 5,606,955

[45] Date of Patent: Mar. 4, 1997

[54] APPARATUS FOR DISPOSING OF FUEL VAPOR

[75] Inventor: Shuji Yuda, Susono, Japan

[73] Assignee: Toyota Jidosha Kabushiki Kaisha, Aichi, Japan

[21] Appl. No.: 516,053

[22] Filed: Aug. 17, 1995

[30] Foreign Application Priority Data

Sep. 1, 1994 [JP] Japan ..... 6-208859

[51] Int. Cl.[6] ..... F02M 25/08; F02D 41/14

[52] U.S. Cl. ..... 123/520

[58] Field of Search ..... 123/518, 519, 123/520

[56] References Cited

U.S. PATENT DOCUMENTS

| | | | |
|---|---|---|---|
| 4,677,956 | 7/1987 | Hamburg | 123/520 |
| 4,741,318 | 5/1988 | Kortge et al. | 123/520 |
| 4,865,000 | 9/1989 | Yajima | 123/520 |
| 5,226,398 | 7/1993 | Cook et al. | 123/520 |
| 5,343,846 | 9/1994 | Ogawa et al. | 123/520 |
| 5,351,193 | 9/1994 | Poirier et al. | 123/520 |
| 5,353,770 | 10/1994 | Osanai et al. | 123/520 |
| 5,355,862 | 10/1994 | Muramatsu et al. | 123/520 |
| 5,425,349 | 6/1995 | Nagaishi et al. | 123/520 |
| 5,429,098 | 7/1995 | Tomisawa | 123/520 |
| 5,445,132 | 8/1995 | Isobe et al. | 123/520 |
| 5,469,832 | 11/1995 | Nemoto | 123/520 |
| 5,474,049 | 12/1995 | Nagaishi et al. | 123/520 |

FOREIGN PATENT DOCUMENTS 6241129A 8/1994 Japan .

*Primary Examiner*—Thomas N. Moulis
*Attorney, Agent, or Firm*—Kenyon & Kenyon

[57] ABSTRACT

The apparatus is arranged with a duty control valve 21 in a passage 19 for purged gas, connected between a canister 16 which temporarily traps fuel vapor and an air-intake passage 23 of an engine 1. The valve 21 is controlled to open and close at predetermined interval and supplies the purged gas to the air-intake passage 23. The apparatus comprises an interval changing means for changing an ON-OFF interval of the valve 21 shorter than normal at the particular engine operating condition. Another apparatus equipped with a multiple cylinder engine comprises a cylinder selecting means for selecting a cylinder sucking in the largest volume of the purged gas, and a torque fluctuation preventing means for equalizing the combustion pressure in all cylinders of the engine.

7 Claims, 9 Drawing Sheets

MAP (DRIVING FREQUENCY OF D.VSV)

| NE / GN (LOAD) | A | B |
|---|---|---|
| a | $\alpha$ | $\beta$ |
| b | $\delta$ | $\zeta$ |

| | |
|---|---|
| CONCENTRATION OF PURGED GAS | a ---------- b |
| RETARD ANGLE | A ---------- B |

APPARATUS FOR DISPOSING OF FUEL VAPOR

BACKGROUND OF THE INVENTION

1. Field of the Invention

The present invention relates to an apparatus for disposing of fuel vapor, and more particularly, to an apparatus for disposing of fuel vapor which improves drivability of a vehicle by shortening an ON-OFF interval of a duty control valve under a predetermined operating condition of an engine, or by equalizing engine output torque in such a manner that an appropriate amount of fuel is injected into each cylinder of the engine or that the ignition timing of each cylinder is adjusted, wherein the appropriate amount of fuel or the ignition timing is determined by a method having the steps of calculating traveling time of a vapor laden air (purged gas) from the duty control valve to an intake port of the engine and detecting the cylinder into which the purged gas is sucked.

2. Description of the Related Art

Generally, internal combustion engines are provided with an evaporative emission-control system which prevents escape of fuel vapor evaporated from a fuel tank and a carburetor into the open air when the engine is stopped. The evaporative emission-control system has a canister filled with an adsorbent such as an activated charcoal, for trapping fuel vapor (HC) from the fuel tank and the carburetor. In the evaporative system, the fuel vapor trapped in the canister is sucked into the combustion chambers of the engine due to the negative air pressure generated by the engine during is running.

As one such evaporative system, there is an apparatus for disposing of fuel vapor which is disclosed in Japanese Unexamined Patent Publication (Kokai) No. 62-174557. This apparatus is provided for the purpose of properly mixing air-intake with fuel vapor, suppressing fluctuations in air-fuel ratio, and improving the stability of output torque of an engine. The apparatus executes a process, namely, a purging process which returns fuel vapor trapped in the canister back to the air-intake side of the engine. The apparatus determines a duty ratio of an electromagnetic duty control valve, to change the flow rate of the purged gas in accordance with engine operating conditions and determine a driving frequency of the duty control valve which is inversely proportional to the duty ratio. The apparatus actuates the electromagnetic valve in accordance with the determined duty ratio and the driving frequency, thus controlling the purging process. However, although the air-intake and fuel vapor can be properly mixed, there is a problem of noise occurrence due to the activation of the electromagnetic valve since the duty ratio is set low and the driving frequency of the electromagnetic valve is set high when engine load is light such as idling time.

To solve this problem, there is provided another apparatus for disposing of fuel vapor which is disclosed in Japanese Unexamined Utility Model publication (Kokai) No. 4-1658 and entitled "Canister Purge Controller". This apparatus for disposing of fuel vapor sets the duty ratio of a purge control valve which purges a minimum required volume of the purged gas at idling time in order to reduce noise occurrence at idling time, and it also reduce the noise at idling time by setting the driving frequency of the electromagnetic duty control valve low.

However, the above mentioned apparatus for disposing of fuel vapor sets a low driving frequency of the electromagnetic duty control valve (DVSV) only at engine idling time. When the duty control valve (DVSV) periodically opens and closes even at engine idling time, the air-fuel ratio of the engine periodically changes such that the air-fuel ratio becomes rich when the duty control valve (DVSV) is opened, and the ratio becomes lean when the duty control valve (DVSV) is closed. This fluctuation of the air-fuel ratio increases proportionally to the concentration of the purged gas, destabilizes the engine combustion state and changes the engine output torque, thereby deteriorating the drivability of the vehicle and creating exhaust emissions. Furthermore, the higher driving frequency of the DVSV, reduces the lifetime of the DVSV valve.

Regarding the concentration of the purged gas, there is a problem that the engine combustion state changes due to the fluctuation of the air-fuel ratio caused by an increase of the concentration of the purged gas. Regarding an apparatus for disposing of fuel vapor by using an EGR (Exhaust-gas recirculating) system, there is a problem in that the engine combustion state changes depending on the volume of exhaust gas recirculating in the EGR system. In an automatic transmission (A/T) vehicle equipped with a torque converter, the converter absorbs torque fluctuation of the engine when the torque converter is not locked, however drivability of the vehicle is deteriorated because of resonance which occurs when the torque converter is used and the period of torque fluctuation of the engine is close to a resonant frequency in the driving mechanism of the vehicle.

Furthermore, an apparatus for disposing of fuel vapor according to the prior art destabilizes the engine combustion state and fluctuates the output torque of the engine when the volume of the purged gas sucked into each cylinder of a multi-cylinder engine is very different between each of the cylinders, thereby deteriorating the drivability of the vehicle and creating exhaust emissions in the same way as the previously described prior art apparatus.

SUMMARY OF THE INVENTION

The present invention has been made in view of the foregoing problems and it is therefore a first object of the present invention to provide an apparatus for disposing of fuel vapor which solves the above mentioned problems, namely, the apparatus suppresses fluctuations of the engine output torque even though the DVSV is periodically opened, maintains stable drivability of the vehicle, and reduces exhaust emissions under certain engine operating conditions which make the engine combustion state unstable even at idling time. The following are such conditions. The concentration of the purged gas is high, the EGR rate is over a predetermined range, or an A/T vehicle equipped with a torque converter is locked up.

A second object of the present invention is to provide an apparatus for disposing of fuel vapor, which also suppresses fluctuations of the engine output torque, maintains stable drivability of the vehicle, and reduces exhaust emissions as much as possible, of fluctuations in the volume of the purged gas sucked into each cylinder of a multi-cylinder engine.

To realize the first object of the present invention, the apparatus for disposing of fuel vapor, in which a duty control valve is arranged in a passage for purged gas. The duty control valve is connected between a canister which temporarily traps fuel vapor and an air-intake passage of an engine, and is controlled to open and close at predetermined intervals in order to supply the fuel vapor trapped in the canister to the air-intake passage such that the flow rate of the purged gas becomes a flow rate corresponding to the intake-air flow rate. The apparatus is characterized in that it comprises an interval changing means for changing an open/close interval of the duty control valve to be shorter than a normal setting when a vehicle is running in an engine operating condition influenced by inflow of the purged gas.

In another apparatus of the present invention for disposing of fuel vapor, the operating condition is determined based on a concentration of the purged gas being taken into a surge tank in the air-intake passage.

In another apparatus of the present invention for disposing of fuel vapor, the operating condition is determined based on an amount of exhaust gas being recirculated through the intake manifold of an engine.

In another apparatus of the present invention for disposing of fuel vapor, the operating condition is determined as a lock-up state of a torque converter of an engine.

To realize the second object of the present invention, the apparatus for disposing of fuel vapor equipped with a multiple cylinder engine, in which a duty controlled valve is arranged in a passage for purged gas. The duty control valve is connected between a canister which temporarily traps fuel vapor and an air-intake passage of the engine, and is controlled to open and close at predetermined intervals in order to supply the fuel vapor trapped in the canister to the air-intake passage such that flow rate of the purged gas becomes constant corresponding to an intake-air flow rate. The apparatus comprises:

a cylinder selecting means which calculates a traveling time of the purged gas from the duty control valve to an intake port, and selects a cylinder which can suck in the largest volume of the purged gas in accordance with the result of the calculated traveling time; and a torque fluctuation preventing means which equalizes output torque generated by each cylinder of the engine by adjusting the combustion pressure of each cylinder.

The apparatus for disposing of fuel vapor of the present invention comprises an interval changing means for changing the driving frequency of the electromagnetic valve of a DVSV, whereby the driving interval of the DVSV is shortened under an engine operating condition such that the air-fuel ratio of the engine largely fluctuates, resulting in an equalization of the output torque of the engine.

Another apparatus for disposing of fuel vapor of the present invention comprises a cylinder selecting means which calculates traveling time of the purged gas from the DVSV to an intake port and selects the cylinder which can suck in the greatest volume of the purged gas in accordance with the result of the calculated traveling time, and a torque fluctuation preventing means which suppress fluctuations of the engine output torque by adjusting the combustion pressure of each cylinder of the engine to equalize the torque. This adjustment can be accomplished by setting the ignition timing of each cylinder or by adjusting fuel injection volume for each cylinder, depending on the volume of the purged gas sucked into each cylinder.

BRIEF DESCRIPTION OF THE DRAWINGS

The present invention will be more clearly understood from the description set forth below with reference to the accompanying drawings, wherein.

DESCRIPTION OF THE PREFERRED EMBODIMENTS

Figure 1:
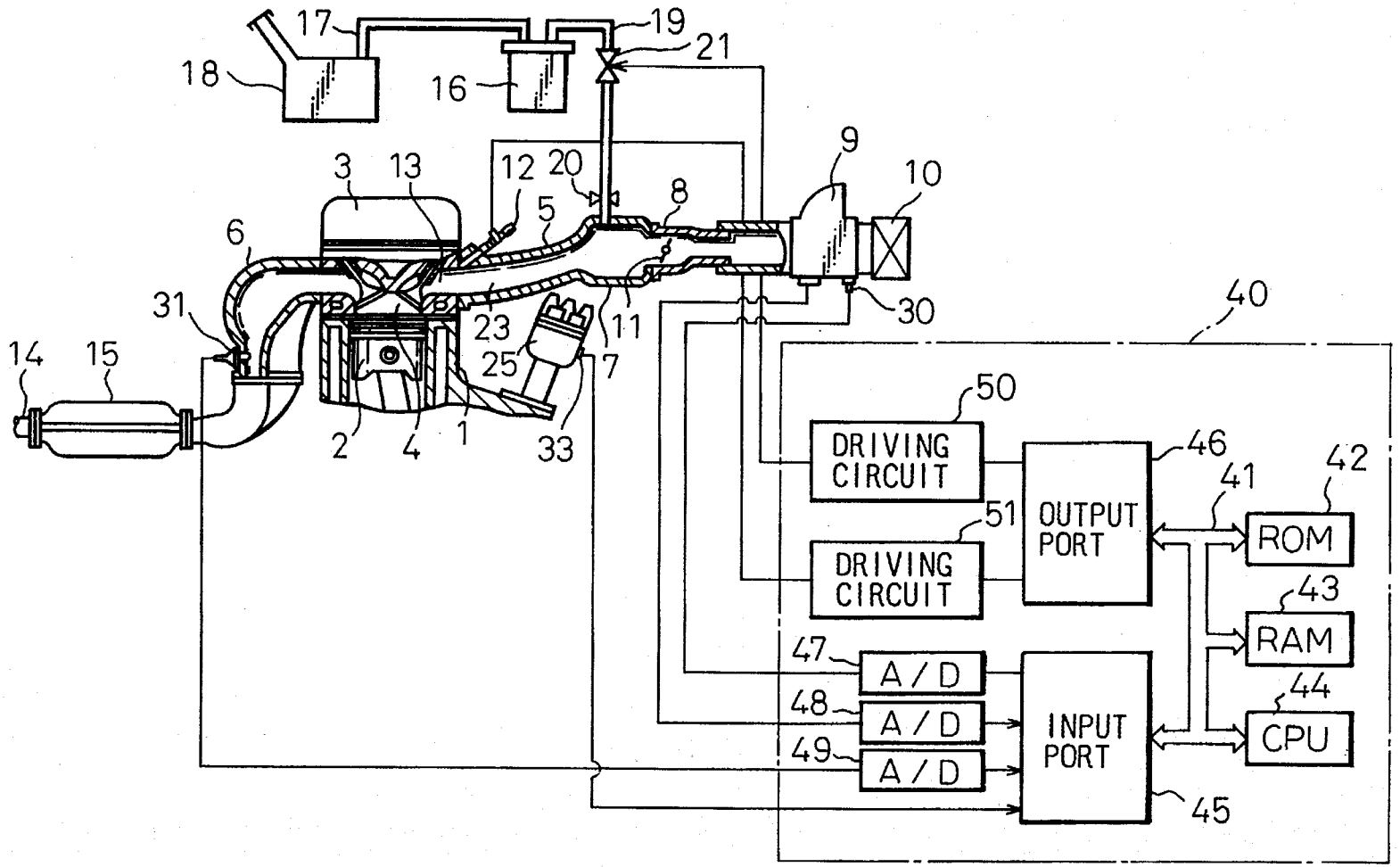
FIG. 1 is a block diagram showing the constitution of an embodiment of the present invention.

FIG. 1 is a block diagram showing the constitution of an embodiment of the present invention. In FIG. 1, reference numeral 1 designates a cylinder block, 2 designates a piston, 3 designates a cylinder head, 4 designates a combustion chamber, 5 designates an intake manifold and 6 designates an exhaust manifold, respectively. The intake manifold 5 is connected to an air cleaner 10 via a surge tank 7, an intake duct 8 and an air-flow meter 9 in order. A throttle valve 11 is arranged inside the intake duct 8, and a fuel injection valve 12 is arranged inside the intake manifold 5 so as to inject toward an intake port 13. On the other hand, an exhaust manifold 6 is connected to an exhaust pipe 14 and a three-way catalyst 15 is arranged inside the exhaust pipe 14 on the way to the exit of the exhaust pipe 14. A canister 16 is connected to the surge tank 7 through a purge passage 19. A duty control valve (DVSV) 21 is arranged inside a purge passage 19 between the canister 16 and the surge tank 7. This duty control valve 21 is controlled by an electronic control unit 40.

Figure 2A:
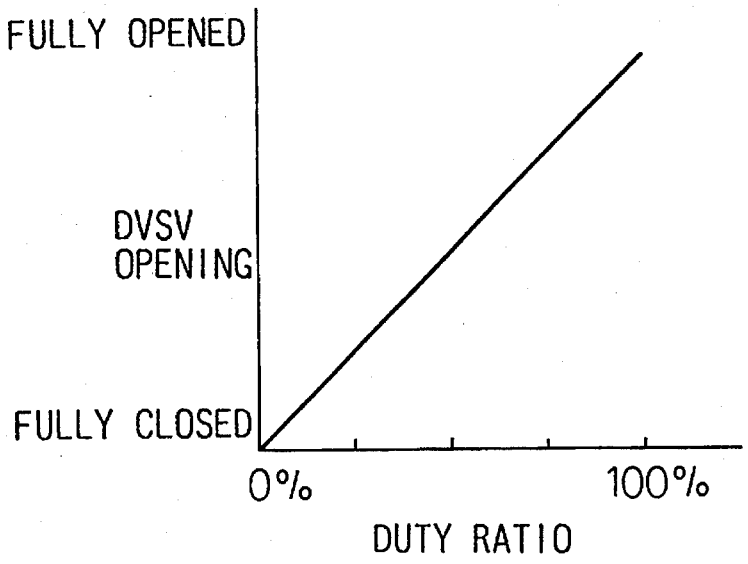
FIG. 2A is a graph showing a relationship between duty ratio and valve opening of a duty control valve.

FIG. 2A shows a relationship between duty ratio and opening of a duty control valve. From FIG. 2A, it can be seen that opening of the duty control valve 21 is proportional to duty ratio, the valve 21 is fully closed at a 0% duty ratio and is fully opened at a 100% duty ratio.

Figure 2B:
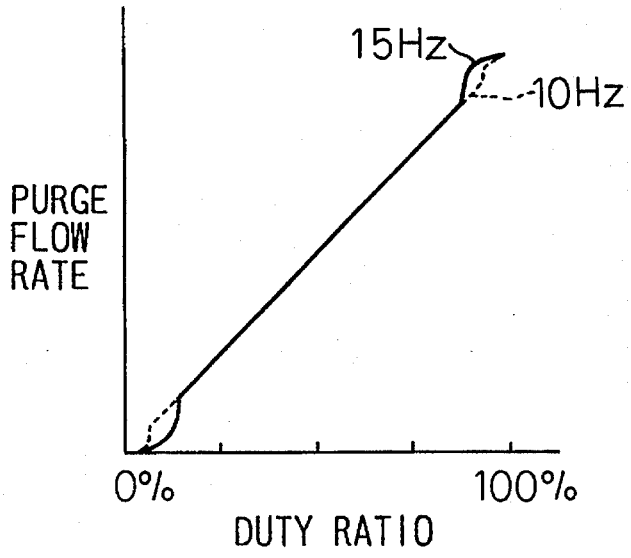
FIG. 2B is a graph showing a relationship between duty ratio and volume of the purged gas.

FIG. 2B shows a relationship between duty ratio and volume of the purged gas. From FIG. 2B it can be seen that the purge flow rate linearly increases from a 12% to 88% duty ratio when driving frequency of the duty control valve is 15 Hz (indicated by a continuous line), while the purge flow rate linearly increases from a 7% to 93% duty ratio when the driving frequency is 10 Hz (indicated by dotted line). Accordingly, the control range of the duty control valve having a 10 Hz driving frequency is broader than that of the duty control valve having a 15 Hz driving frequency.

Returning to FIG. 1, an electronic control unit 40 may be made by a digital computer system, which comprises a central processing unit (CPU) 44, a read only memory (ROM) 42 for storing a main routine, interrupt routines such as a fuel injection routine, an ignition timing routine, tables (maps), and constants, etc., a random access memory (RAM) 43 for storing temporary data, an input port 45 and an output port 46. These are mutually connected through a bi-directional bus 41. An intake-air temperature sensor 30 arranged inside the air-flow meter 9 detects the intake-air temperature and outputs its output signal to the input port 45 through an analog-to-digital (A/D) converter 47. The air-flow meter 9 generates output voltage proportional to the intake-air volume per a unit time, and this output voltage is applied to the input port 45 through the A/D converter 48. An $O_2$ sensor 31 arranged inside the exhaust manifold 6 detects oxygen density in exhaust air and outputs its output signal to the input port 45 through the A/D converter 49. A crank angle (CA) sensor 33 for detecting the rotational angle of the crankshaft (not shown) of the engine 1, which is arranged in a distributor 25, generates pulse signals at determined crank angles (CA). These pulse signals represent the engine rotational speed and are input to the input port 45. The output port 46 is connected to the duty control valve 21 and the fuel injection valve 12 through the corresponding driving circuits 50 and 51.

Fuel vapor trapped in the canister 16 is sucked into the intake passage 23 via the surge tank 7 while the duty control valve 21 is opened. The duty control valve 21 opens and closes at determined periods. In this case, opening of the duty control valve 21 is controlled so that the purge flow rate of the fuel vapor increases proportionally to the intake-air flow rate. Fuel injection volume injected to the intake passage 23 from the fuel injector 12 toward the intake port 13 is controlled to be corrected so that the air-fuel ratio is not varied by changes in the volume of purged gas sucked in.

An apparatus for disposing of fuel vapor according to a first aspect of the present invention is provided with the duty control valve 21 arranged in the purge passage 19. The control valve 21 periodically opens and closes at determined intervals. The canister 16 for temporarily trapping fuel vapor is connected to the intake passage 23 through the purge passage 19. The duty control valve 21 is controlled to open and flow the fuel vapor trapped in the canister 16 into the intake passage 23 so that the purge flow rate becomes constant corresponding to the intake-air flow rate. The apparatus for disposing of fuel vapor is provided with an interval changing means in the electronic control unit 40 which shortens the determined open/close interval of the duty control valve 21 when the engine is under a previously determined operating condition. That is to say, this interval changing means controls the frequency of the driving circuit 50 for driving the duty control valve 21 by means of the CPU 44 via the output port 46 when the engine is under the previously determined operating condition. Hereinunder, the previously determined engine operating condition will be explained with reference to the accompanying drawings.

Figures 3, 4:
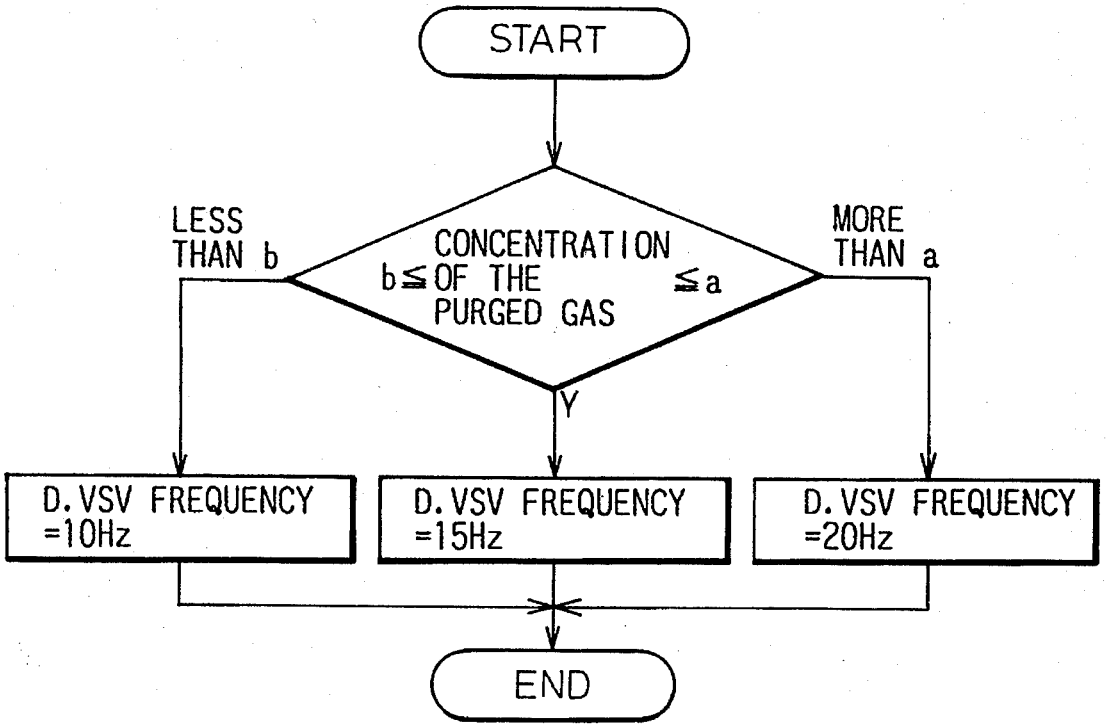
FIG. 3 is a map for determining a driving frequency of the DVSV from engine rotational speed and load (intake-air pressure)
FIG. 4 is a flowchart showing the process for determining driving frequencies of the DVSV corresponding to concentration of the purged gas.

FIG. 3 is a map for determining a driving frequency of the DVSV from engine rotational speed and load (intake-air pressure). This map data is stored in the ROM 42. The CPU 44 determines the driving frequency corresponding to input data, engine rotational speed NE and load GN, based on the map, then the electromagnetic solenoid valve (the duty control valve) 21 is energized in accordance with the determined driving frequency. Required strength of engine combustion is different depending on engine rotational speed and load, therefore the driving frequencies stored in the MAP are set to 15 Hz for strong engine combustion, and 10 Hz for weak engine combustion.

FIG. 4 is a flowchart showing the process for determining driving frequencies of the DVSV corresponding to concentration of the purged gas.

The higher the concentration of the purged gas, the larger the fluctuation of air-fuel (A/F) ratio caused by purging the fuel vapor trapped in the canister. Therefore, the fluctuation of the A/F can be suppressed by making the driving frequency of the DVSV high, namely, by making the period of the frequency short. In an example shown in FIG. 4, driving frequencies are set to 10 Hz when the concentration of the purged gas <b%, 15 Hz when b% ≦ the concentration ≦a%, and 20 Hz when the concentration <a%.

Figure 5:
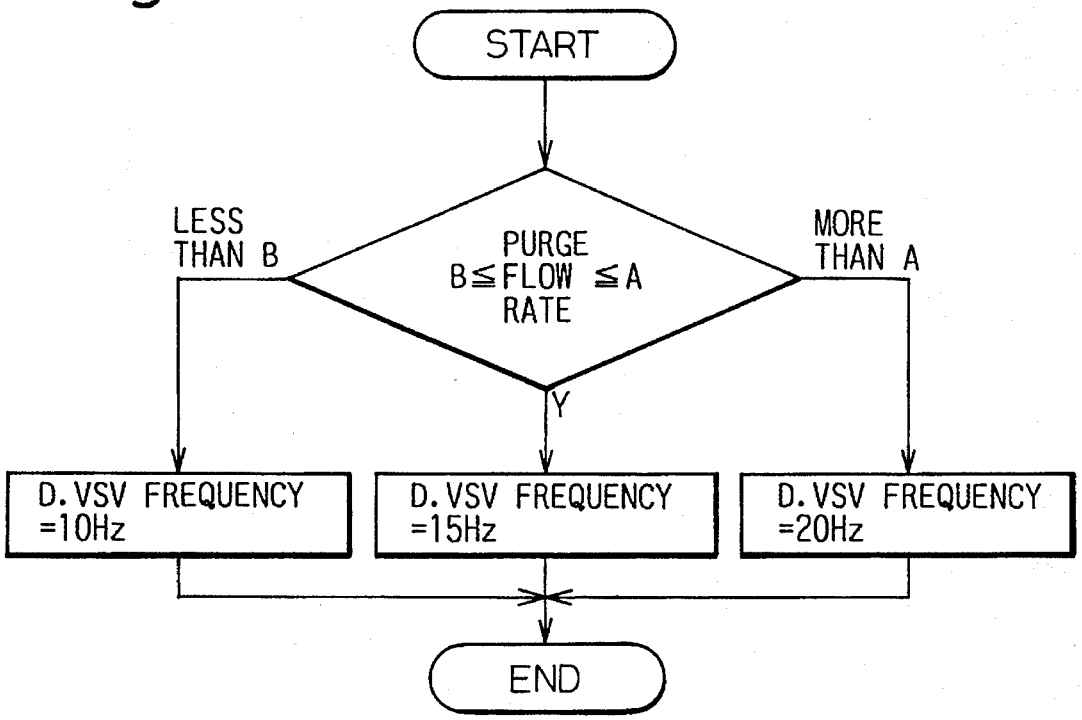
FIG. 5 is a flowchart showing the process for determining driving frequencies of the DVSV corresponding to purge flow rate.

FIG. 5 is a flowchart showing the process for determining driving frequencies of the DVSV corresponding to purge flow rate. Even if the concentration of the purged gas is constant, the fluctuation of the air-fuel (A/F) ratio becomes large as the purge flow rate increases. Therefore, the fluctuation of the A/F ratio can be suppressed by making the driving frequency of the DVSV higher, namely, by shortening the period of the driving frequency. In an example shown in FIG. 5, driving frequencies are set to 10 Hz when the purge flow rate <B%, 15 Hz when B% ≦ the purge flow rate ≦A%, and 20 Hz when the purge flow rate >A%.

Figure 6:
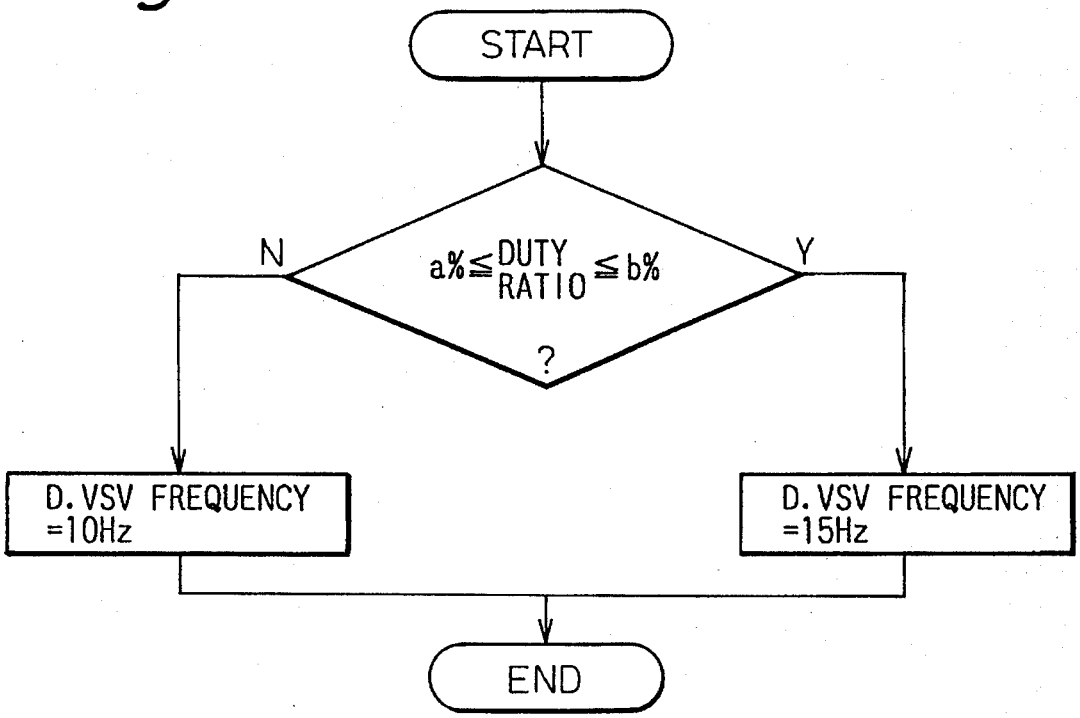
FIG. 6 is a flowchart showing the process for determining driving frequencies of the DVSV corresponding to duty ratio.

FIG. 6 is a flowchart showing the process for determining driving frequencies of the DVSV corresponding to duty ratio. As pulsation of the purged gas becomes the highest in the vicinity of 50% duty ratio, so the fluctuation of air-fuel (A/F) ratio also becomes large. Therefore, the fluctuation of A/F can be depressed by setting the driving frequency of DVSV high, namely, by setting the interval of the driving frequency short in the vicinity of a 50% duty ratio. In an example shown in FIG. 6, the driving frequencies of DVSV are set to 10 Hz when duty ratio <a% or b% < duty ratio, and 15% when a% ≦ duty ratio ≦b%. Furthermore, as shown in FIG. 2B, the relationship between duty ratio and purge flow rate with regard to proportion, namely, the DVSV characteristic, does not change depending on driving frequency. Therefore, it should be noted that changing the driving frequency in the vicinity of a 50% duty ratio does not influence the purge control. It should also be noted that driving frequency of 10 Hz in the vicinity of a 0% and 100% duty ratio has wider control range closer to a 0% and 100% duty ratio than the control range of the driving frequency of 15 Hz.

Figure 7:
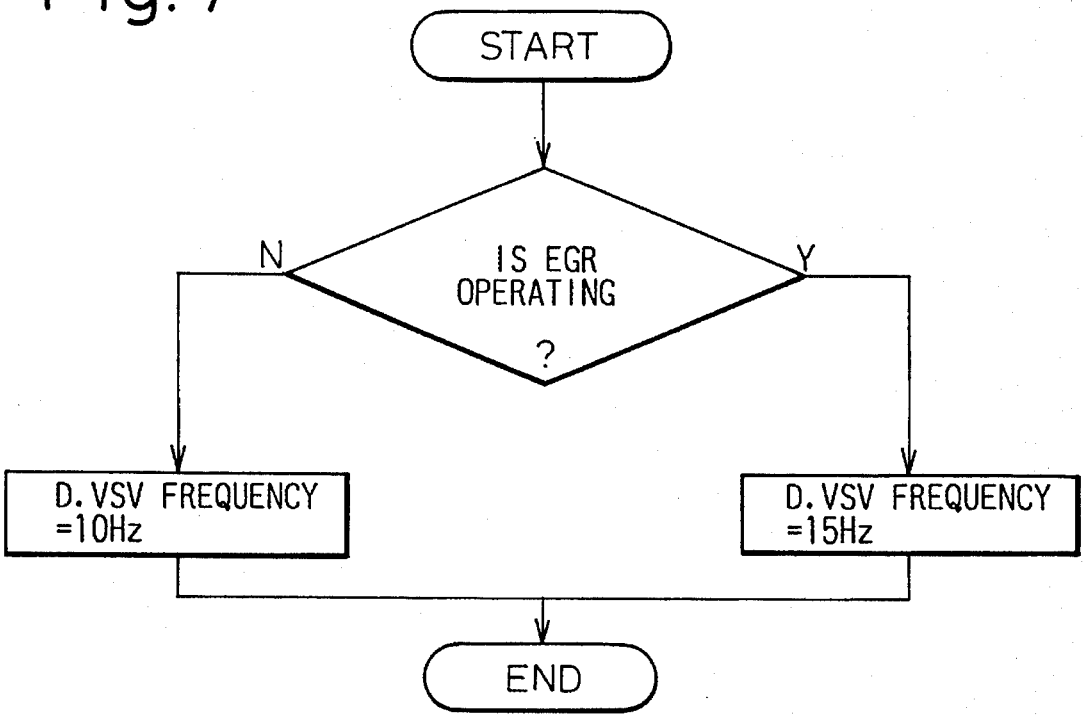
FIG. 7 is a flowchart showing the process for determining driving frequencies of the DVSV depending on whether an exhaust-gas recirculation (EGR) system is in operation or not.

FIG. 7 is a flowchart showing the process for determining driving frequencies of the DVSV depending on whether the exhaust-gas recirculation (EGR) system is operating or not. EGR is a means for reducing NOx in exhaust gas from the engine, which recirculates a part of the exhaust gas to the intake side and mixes with intake-air, decreases maximum temperature during engine combustion, and reduces creation of NOx. Which means EGR weakens combustion of the engine, therefore fluctuation of engine output torque occurs. The fluctuation of air-fuel ratio (A/F) under EGR operation becomes higher than that when EGR is not operating. Therefore the fluctuation of A/F can be suppressed by increasing the driving frequency of the DVSV, namely by shortening the interval of the driving frequency. In an example shown in FIG. 7, the driving frequency of the DVSV is set 10 Hz when EGR is not operating, while it is set 15 Hz when EGR is operating.

Figure 8:
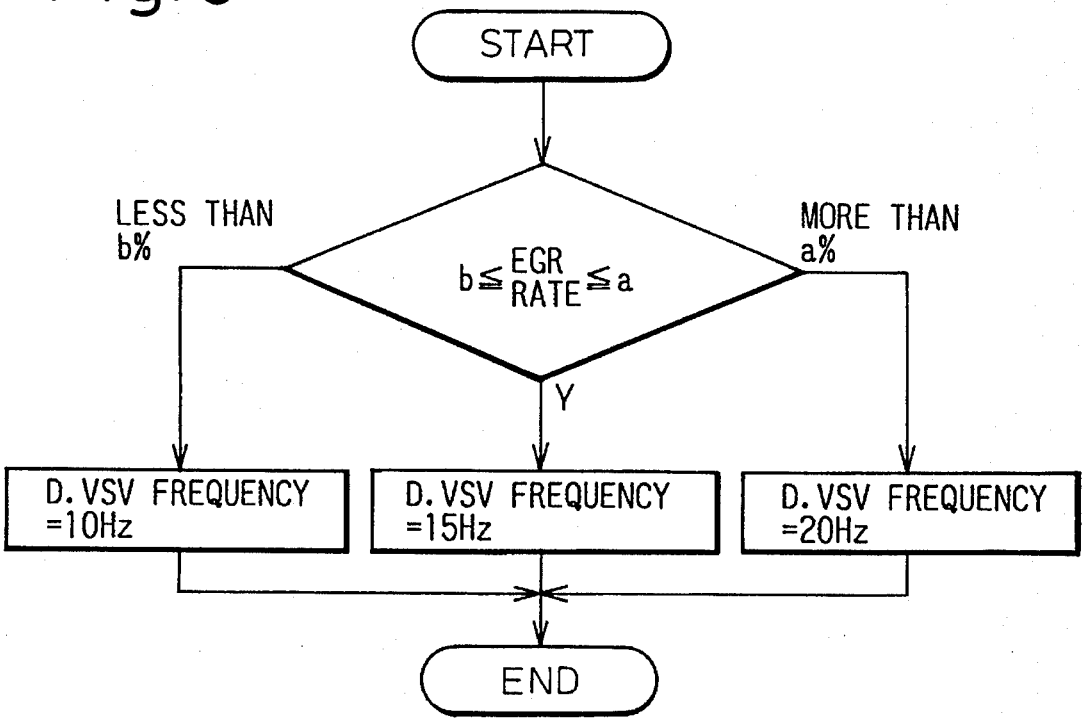
FIG. 8 is a flowchart showing the process for determining driving frequencies of the DVSV corresponding to EGR rate.

FIG. 8 is a flowchart showing the process for determining the driving frequencies of the DVSV corresponding to EGR rate. EGR rate is a ratio of the circulated exhaust gas volume to summation of the intake-air volume and the circulated exhaust gas volume. For the same reason explained above, the driving frequency of the DVSV is set to 10 Hz when EGR rate <b%, 15% when b% ≦ EGR rate ≦a%, and 10% when a <% EGR rate >a%.

Figure 9:
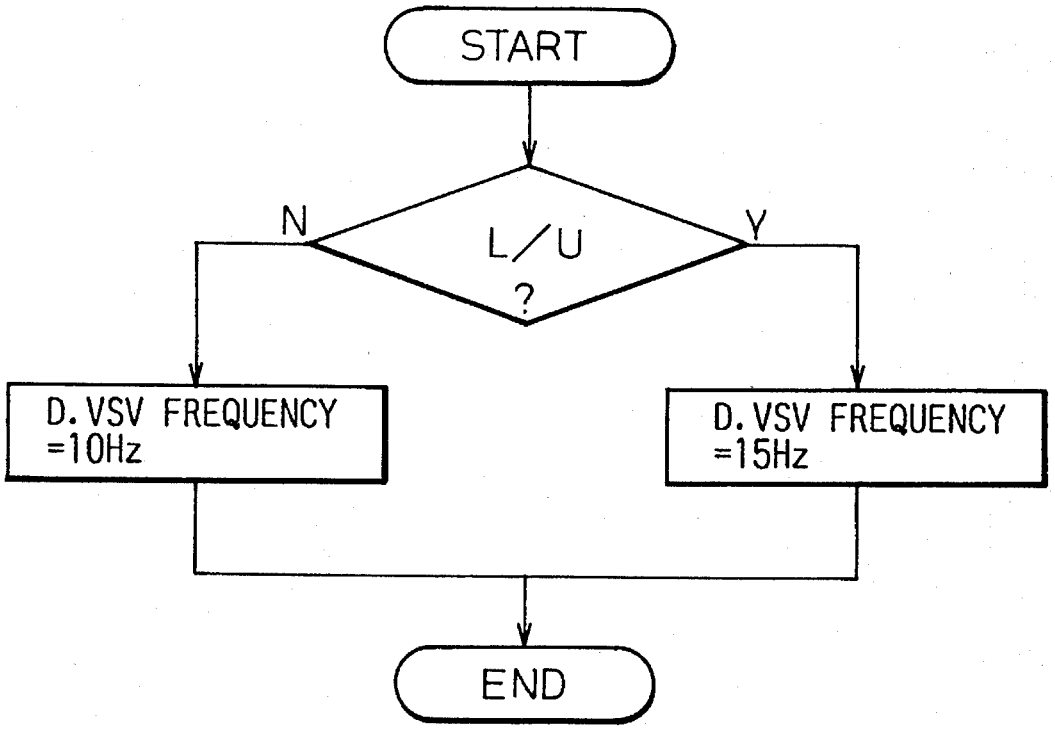
FIG. 9 is a flowchart showing the process for determining driving frequencies of the DVSV depending on whether L/U is set or not.

FIG. 9 is a flowchart showing the process for determining the driving frequencies of the DVSV valve depending on whether L/U is set or not. In the case of automatic transmission (A/T) vehicles with a torque converter installed, the torque fluctuation can be absorbed when the torque converter is not locked up. However resonance occurs when the torque converter is locked up and the period of the torque fluctuation of the engine is close to the resonant frequency existing in the driving mechanism of the vehicles, so that drivability is deteriorated. Therefore, the fluctuation of A/F can be suppressed by increasing the driving frequency, namely shortening the period of the driving frequency. In an example shown in FIG. 9, the driving frequency of the DVSV is set to 10 Hz when the torque converter is not locked up, and 15 Hz when the torque converter is locked up. This lock up mechanism automatically changes oil flow inside the torque converter, thereby pushing a clutch facing a cover of the torque converter when the speed of the vehicle is equal to or greater than approximately 55 km per hour, for the purpose of avoiding the reduction of fuel consumption efficiency due to the energy loss by fluid slip of the torque converter which provides smooth driving by transmitting dynamic power via fluid.

As a result, an engine is mechanically and directly connected to driving wheels so that fuel consumption efficiency can be improved. Practically, determining whether the lock-up mechanism is locked or not is replaced by determining whether the vehicle is driven faster than 55 km per hour or not.

An apparatus for disposing of fuel vapor according to a second aspect of the present invention also shown in FIG. 1. The apparatus is provided with a cylinder selecting means which calculates a traveling time of the purged gas from the duty control valve 21 to each intake port 13 of each cylinder of the engine 1, and selects a cylinder which sucks in the greatest volume of the purged gas in accordance with the result of the calculation. The apparatus is also provided with a torque fluctuation preventing means which equalizes engine output torque of each cylinder of the engine by controlling combustion pressure inside each cylinder. The engine of this apparatus is a multi-cylinder type. Hereinafter the cylinder selecting means and the torque fluctuation preventing means will be explained.

Figures 10A, 10B:
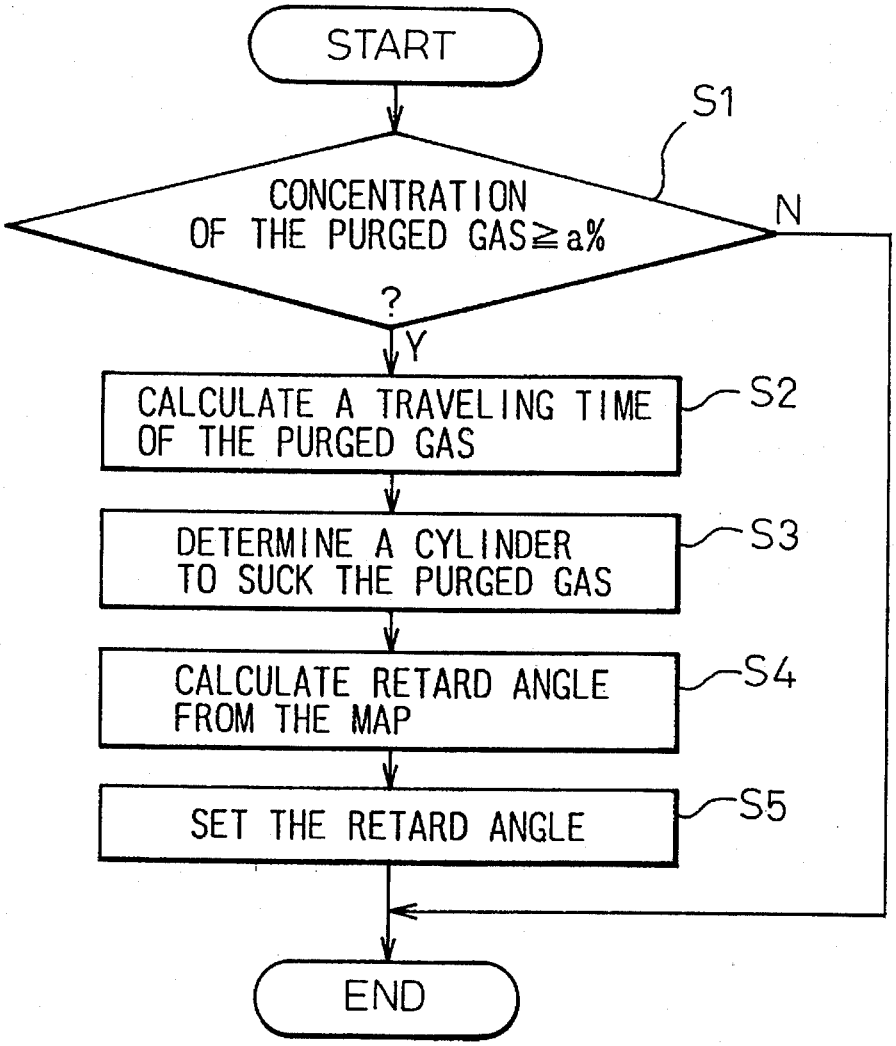
FIG. 10A is a flowchart for explaining an equalization process of engine output torque by controlling delay angle of ignition timing of each cylinder corresponding to volume of the purged gas sucked into each cylinder of the engine.
FIG. 10B is a map for determining retard angle of ignition timing in relation to top dead center (TDC) corresponding to concentration of the purged gas.

FIG. 10A is a flowchart for explaining an equalization process of engine output torque by controlling retard angle-of the ignition timing of each cylinder corresponding to volume of the purged gas sucked into each cylinder of the engine, and FIG. 10B is a map for determining retard angle of the ignition timing in relation to TDC corresponding to the concentration of the purged gas. In the explanation of the following flowcharts, the number following after the letter "S" indicates step numbers.

First, at step S1, it is determined whether or not the concentration of the vapor-laden air (purged gas) is equal and/or greater than a%. If the result is Yes, the flow proceeds to step S2, and if the result is No, the process is stopped.

At step S2, a traveling time of a volume of the purged gas from the DVSV to the intake port of the engine is calculated based on a map (not shown) to determine the traveling time from the current engine rotational speed or another two dimensional map (not shown) to determine the same from the current engine rotational speed and load.

At step S3, a cylinder into which the most purged gas flown from the DVSV was sucked is determined based on the result of the calculation at step S2 and data of the open timing of the intake valve (intake-air valve of the cylinder of the multi-cylinder engine).

At step S4, the retard angle of the ignition timing is determined based on the map shown in FIG. 10B. Data of this map is stored in the ROM 42.

At step S5, the retard angle determined at step S4 is set for the corresponding cylinder determined at step S3.

In this way, the ignition timing of each cylinder is adjusted and the combustion of the engine is equalized, so that imbalance of the engine output torque is suppressed.

The electronic control unit 40 executes the process of the above mentioned flowchart, in which the cylinder selecting means executes steps S1, S2 and S3, and the torque fluctuation preventing means executes steps S4 and S5.

Figure 11:
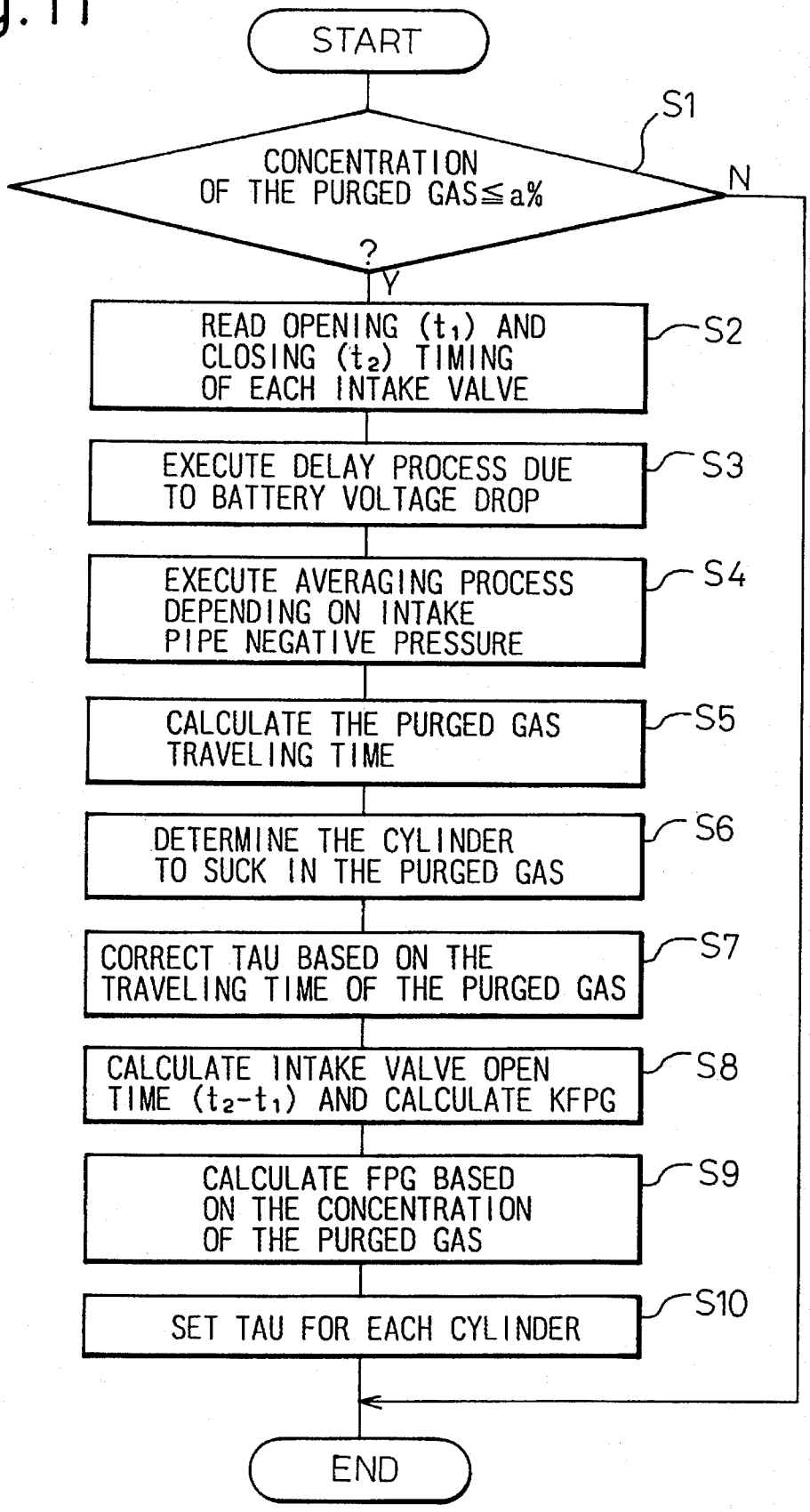
FIG. 11 is a flowchart for explaining an equalization process of engine output torque by controlling fuel injection volume into each cylinder of a multi-cylinder engine corresponding to the purged gas volume sucked into each cylinder.

FIG. 11 is a flowchart for explaining an equalization process of engine output torque for each cylinder of a multi-cylinder engine by controlling fuel injection volume into each cylinder corresponding to the purged gas volume sucked into each cylinder. The electronic control unit 40 executes the process of this flowchart, in which the cylinder selecting means executes steps S1, S2, S5 and S6, and the torque fluctuation preventing means executes steps S3, S4, S7, S8, S9 and S10.

First at step S1, it is determined whether or not the concentration of the purged gas is equal and/or greater than a%. And, if the result is YES, the flow proceeds to step S2, and if the result is No, the process is finished.

At step S2, the opening (t1) and closing (t2) timings of each intake valve of each cylinder are read and stored based on a sensor signal of the crank-angle sensor 33 by sampling the timing data t1 and t2, for example, every 0.1 second when the driving frequency of the DVSV is 10 Hz.

At step S3, voltage drop of the battery of the vehicle is read and the response delay time of the DVSV is compensated in accordance with the dropped voltage.

At step S4, an averaging process depending on the intake pipe negative pressure is executed. This means that TAU, namely, the fuel injection period, is finally corrected by calculating a TAU equation expressed with a moving averaging constant which changes in response to the change of the negative pressure of the intake-air pipe.

Then at step S5, the purged gas traveling time from the DVSV to the intake port of the engine is determined based on a two dimensional map depending on factors of engine rotational speed and load (negative pressure inside the intake pipe). Data for the two dimensional map is stored in the ROM 42, this data being obtained by experimentally measuring traveling time corresponding to the factors of engine rotational speed and load.

At step S6, which one of multiple cylinders in the engine sucks in the greatest volume of the purged gas from the DVSV is determined based on the result of step S5 and the ON-OFF timing of the intake-air valve.

At step S7, a fuel injection period (TAU) is corrected based on the moving average time of the purged gas flown from the DVSV and staying in the surge tank 7. This TAU is corrected by the moving average which is averaged in proportion to the purged gas traveling time described at step S5.

At step S8, an intake valve open time (t2–t1) is calculated, then a correction factor (KFPG) influenced by the pulsation of the purged gas from the DVSV caused by the ON-OFF action of the DVSV is averaged from the result of the calculated open time. The purged gas is more agitated in the intake passage with the longer opening time of the intake valve.

Then at step S9, the purged gas correction factor (FPG) which deducts the amount of fuel to be injected in the fuel injection period (TAU) is calculated in accordance with the concentration of the purged gas.

At step S10, the fuel injection period (TAU) is calculated based on the FPG calculated at S9 for the fuel injection valve 12 corresponding to the cylinder determined at step S6.

The purged gas correction factor FPG calculated at S9, which indicates the fuel amount (reduction factor from TAU) to be reduced from the basic fuel amount for determining the opening time of the fuel injection valve 12, is given the equation below.

$$FPG=(FGPG\times PGR)\times KFPG \quad (1)$$

where, KFPG denotes a correction factor influenced by the pulsation of the purged gas caused by DVSV ON/OFF operations, FGPG denotes a concentration of the purged gas per a unit of a purge rate, PGR denotes the purge rate, and (FGPG)×(PGR) denotes the reduced fuel amount when the concentration of the purged gas is averaged.

There is no problem with setting a fuel injection period (TAU) constant when the rotational speed of the engine is high. However, a certain volume of the purged gas is purged several times during a period from the time the purged gas is flown from the DVSV until the time the intake-valve is opened to suck in the purged gas, when the rotational speed of the engine is low. Therefore the above equation must be used so that the volume of the purged gas purged several times during this period can be reflected in the TAU calculation.

Figures 12A, 12B, 12C, 12D, 12E:
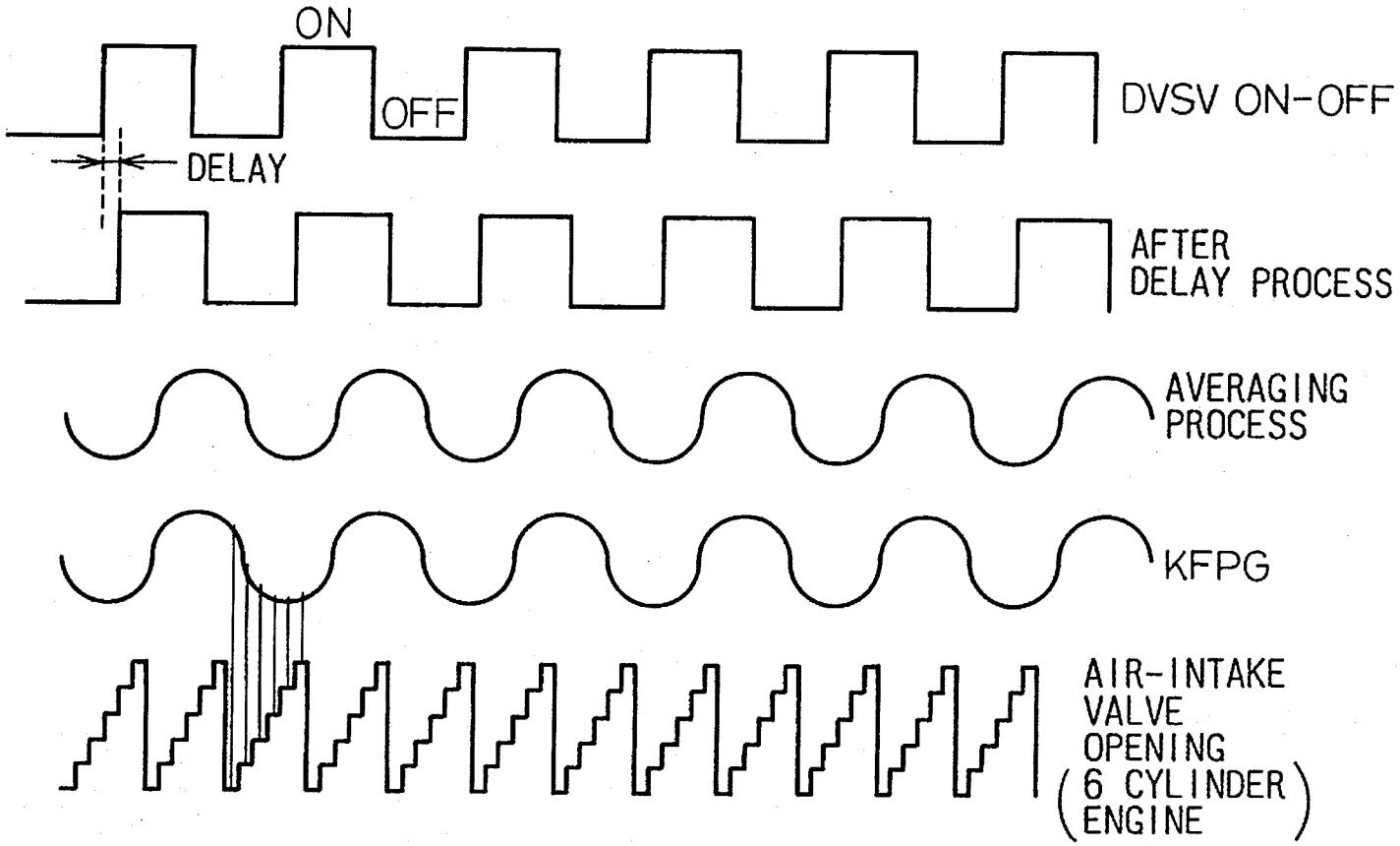
FIG. 12A is a timing chart showing ON-OFF states of the electro-magnetic valve of the DVSV.
FIG. 12B is a timing chart showing ON-OFF states of the electro-magnetic valve after the delay process.
FIG. 12C is a timing chart of a correction factor (averaging constant) obtained after executing an averaging process, namely, step S4 in the flowchart shown in FIG. 11.
FIG. 12D is a timing chart showing a correction factor (KFPG) based on an opening time of the air-intake valve.
FIG. 12E is a timing chart showing the volume of the purged gas sucked into each cylinder when each air-intake valve is open.

FIG. 12A to FIG. 12E are timing charts showing ON/OFF states of the DVSV and volume of the purged gas sucked into each cylinder of a 6-cylinder engine. FIG. 12A is a timing chart showing ON-OFF states of the electro-magnetic valve of the DVSV. FIG. 12B is a timing chart showing ON-OFF states of the electro-magnetic valve of the DVSV after executing the step 53 in the flowchart shown in FIG. 11.

FIG. 12C is a timing chart of a correction factor (moving averaging constant) which is calculated by assuming the flow of the purged gas is delayed with a first order lag. This correction factor corrects the value of TAU, which is a fuel injection period for fuel injected from the fuel injection valve 12, corresponding to the negative pressure in the air-intake pipe.

FIG. 12D is a timing chart of a correction factor KFPG which is calculated based on the volume of the purged gas depending on opening time of the air-intake valve.

This correction factor (KFPG) corrects the value of TAU, namely, a fuel injection period.

FIG. 12E is a timing chart showing the volume of the purged gas sucked into each cylinder of the 6-cylinder engine when the each air-intake valve is opened. This time chart shows the change of the volume of the purged gas sucked into each cylinder of the 6-cylinder engine when the engine rotational speed is low, for the convenience of explanation.

As explained above, the torque fluctuation preventing means according to the present invention adjusts the retard angle of the ignition timing of each cylinder of the multi-cylinder engine or adjusts fuel injection volume to each cylinder which sucks in the greatest volume of the purged gas, thereby equalizing the output torque of the engine generated cylinder by cylinder, and suppressing the torque fluctuation of the engine.

As heretofore explained, the apparatus for disposing of fuel vapor of the present invention which is provided with a frequency changing means for changing driving frequency of the electro-magnetic valve of the DVSV, sets the frequency low at normal engine operating conditions and high at an engine operating condition which makes the air-fuel ratio of the engine largely change, so that the durability of the DVSV can be improved and the fluctuation of the engine output torque can be suppressed. Moreover, the drivability of a vehicle can be satisfied and the exhaust emissions can be reduced.

Furthermore, another apparatus for disposing of fuel vapor of the present invention which is provided with a cylinder selecting means, can detect a cylinder into which the purged gas is sucked in the greatest volume among multiple cylinders of the engine. The purged gas in the apparatus is flown from the DVSV and sucked into the intake-air port. The apparatus can also control the ignition timing or amount of fuel injection corresponding to the purged gas sucked into each cylinder, so that the combustion pressure in each cylinder can be equalized, and fluctuation of the output torque of the engine is suppressed. Moreover, the drivability of a vehicle can be made satisfactory and %he exhaust emissions can be reduced.

I claim:

1. An apparatus for disposing of fuel vapor with a duty control valve arranged in a passage for purged gas, said duty control valve being connected between a canister which temporarily traps fuel vapor and an air-intake passage of an engine, and being controlled to open and close at predetermined intervals in order to supply said fuel vapor trapped in said canister to said air-intake passage such that the flow rate of said purged gas becomes a flow rate corresponding to the intake-air flow rate, said apparatus being characterized in that it comprises an interval changing means for changing an open/close interval of said duty control valve to be shorter than a normal setting, the normal setting corresponding to the open/close interval of said duty control valve when a vehicle is running in an engine operating condition uninfluenced by an inflow of the purged gas.

2. An apparatus for disposing of fuel vapor as set forth in claim 1, wherein said operating condition is determined based on a concentration of said purged gas being taken into a surge tank in said air-intake passage.

3. An apparatus for disposing of fuel vapor as set forth in claim 1, wherein said operating condition is determined based on an amount of exhaust gas being recirculated through said intake manifold of an engine.

4. An apparatus for disposing of fuel vapor as set forth in claim 1, wherein said operating condition is determined as a lock-up state of a torque converter of an engine.

5. An apparatus for disposing of fuel vapor equipped with a multiple cylinder engine with a duty controlled valve arranged in a passage for purged gas, said duty control valve being connected between a canister which temporarily traps fuel vapor and an air-intake passage of said engine, and being controlled to open and close at predetermined intervals in order to supply said fuel vapor trapped in said canister to said air-intake passage such that flow rate of said purged gas becomes a flow rate corresponding to the intake-air flow rate, said apparatus being characterized in that it comprises:

a cylinder selecting means which calculates a traveling time of said purged gas from said duty control valve to an intake port, and selects a cylinder which can suck in the largest volume of said purged gas in accordance with the result of the calculated traveling time; and a torque fluctuation preventing means which equalizes output torque generated by each cylinder of said engine by adjusting the combustion pressure of each cylinder.

6. An apparatus for disposing of fuel vapor in an engine having an air-intake passage, said apparatus comprising:

a purged gas passage;

a canister for temporary containment of the fuel vapor;

a duty control valve arranged in said purged gas passage and interposed between said canister and the air-intake passage;

a controller having an input that senses an engine operating condition and an output that opens and closes said duty control valve at a frequency higher than a required frequency of said duty control valve for a particular inflow of said purged gas, so that the flow rate of the purged gas becomes substantially constant for a given intake-air flow rate.

7. An apparatus for disposing of fuel vapor with a duty control valve arranged in a passage for purged gas, said duty control valve being connected between a canister which temporarily traps fuel vapor and an air-intake passage of an engine, and being controlled to open and close at predetermined intervals in order to supply said fuel vapor trapped in said canister to said air-intake passage such that the flow rate of said purged gas becomes a flow rate corresponding to the intake-air flow rate, said apparatus being characterized in that it comprises an electronic control unit for changing a frequency at which said duty control valve is opened and closed, wherein the electronic control unit operates so that, when a vehicle is running in an engine operating condition uninfluenced by an inflow of the purged gas, the frequency at which the duty control valve is opened and closed is increased.

* * * * *

UNITED STATES PATENT AND TRADEMARK OFFICE

CERTIFICATE OF CORRECTION

PATENT NO. : 5,606,955

DATED : March 4, 1997

INVENTOR(S) : Shuji YUDA

It is certified that error appears in the above-indentified patent and that said Letters Patent is hereby corrected as shown below:

Column 1, line 31, change "is" to --its--.

Column 1, line 44, insert --to-- before "determine".

Column 2, line 58, after "possible" insert --regardless--.

Column 2, line 61, delete the comma after "vapor", delete "in which", and insert --includes-- in its place.

Column 2, line 62, delete "is".

Column 3, line 20, delete "equipped with" and replace with --is incorporated into--.

Column 10, line 50, change "%he" to --the--.

Column 11, line 12, delete "equipped with" and replace with --incorporated into--.

Signed and Sealed this

Fourteenth Day of October, 1997

*Attest:*

Bruce Lehman

BRUCE LEHMAN

*Attesting Officer*

*Commissioner of Patents and Trademarks*